US007331088B2

(12) United States Patent
Pontaoe

(10) Patent No.: US 7,331,088 B2
(45) Date of Patent: Feb. 19, 2008

(54) BUCKLE ASSEMBLY

(75) Inventor: John S. Pontaoe, Chicago, IL (US)

(73) Assignee: Illinois Tool Works Inc, Glenview, IL (US)

( * ) Notice: Subject to any disclaimer, the term of this patent is extended or adjusted under 35 U.S.C. 154(b) by 90 days.

(21) Appl. No.: 11/260,519

(22) Filed: Oct. 27, 2005

(65) Prior Publication Data

US 2006/0168782 A1 Aug. 3, 2006

Related U.S. Application Data

(60) Provisional application No. 60/648,171, filed on Jan. 28, 2005.

(51) Int. Cl.
*A44B 11/25* (2006.01)

(52) U.S. Cl. ..... 24/614; 24/625

(58) Field of Classification Search ..... 24/614, 24/615, 664, 634, 625; D11/216
See application file for complete search history.

(56) References Cited

U.S. PATENT DOCUMENTS

| | | | | |
|---|---|---|---|---|
| 4,779,315 | A * | 10/1988 | Kohus | 24/587.12 |
| 5,465,472 | A * | 11/1995 | Matoba | 24/625 |
| 5,590,444 | A * | 1/1997 | Krauss | 24/625 |
| 5,953,798 | A * | 9/1999 | Matoba et al. | 24/615 |
| 6,421,889 | B1 * | 7/2002 | Chien | 24/614 |
| 6,571,433 | B2 * | 6/2003 | Uehara et al. | 24/614 |
| 6,792,654 | B2 * | 9/2004 | Schmitz | 24/614 |

* cited by examiner

*Primary Examiner*—Robert J. Sandy
(74) *Attorney, Agent, or Firm*—Mark W. Croll; Paul F. Donovan

(57) ABSTRACT

A buckle assembly includes a first housing having first lateral walls, and a second housing having second lateral walls. The second housing securely retains said first housing in a mated position. The first housing disengages from the second housing through manipulation of the first lateral walls at any location along the first lateral walls such that the manipulation of the first lateral walls causes the first housing to disengage from the second housing.

24 Claims, 8 Drawing Sheets

BUCKLE ASSEMBLY

RELATED APPLICATIONS

This application relates to and claims priority benefits from U.S. Provisional Patent Application No. 60/648,171 entitled "Buckle," filed Jan. 28, 2005, which is incorporated by reference herein in its entirety.

FIELD OF THE INVENTION

Embodiments of the present invention generally relate to a buckle assembly, and more particularly, to a side-release buckle assembly that may be used with child automobile seats, athletic gear, backpacks, and the like.

BACKGROUND OF THE INVENTION

Conventional side-release buckle assemblies typically include a female housing that is mated with a male housing. The female housing includes a fixed wall that includes openings bounded by fixed wall structures that receive and retain release mechanisms of the male housing. In order to disengage the male housing from the female housing, the release mechanisms are manipulated, such as by being squeezed together. Typically, the only portions of the buckle assemblies that may be manipulated in order to disengage the male housing are the release mechanisms.

Some users may find it difficult to disengage the male housing from the female housing. In short, if a user's fingers are too bulky, such as when the user is wearing mittens or gloves, portions of the buckle assembly may obstruct the user from fully manipulating the release mechanisms, making it difficult, if not impossible, to disengage the male housing from the female housing. For example, the user's fingers may engage the fixed wall structures of the female buckle housing while trying to squeeze the release mechanisms toward one another, thereby blocking and preventing full manipulation of the release mechanisms into a disengaged position.

Thus, a need exists for a buckle assembly that is quickly and easily buckled and unbuckled. Particularly, a need exists for a buckle assembly that includes a male buckle housing that may be quickly and easily disengaged from a female buckle housing.

SUMMARY OF THE INVENTION

Embodiments of the present invention provide a buckle assembly that includes first and second housings, such as female and male buckle housings. The first and second housings include first and second lateral walls, respectively. The second housing securely retains the first housing in a mated position. The first housing disengages from the second housing through manipulation (such as squeezing, pressing, or otherwise moving) of the first lateral walls at any location along the first lateral walls, such that manipulation of the first lateral walls causes the first housing to disengage from the second housing.

Figure 1:
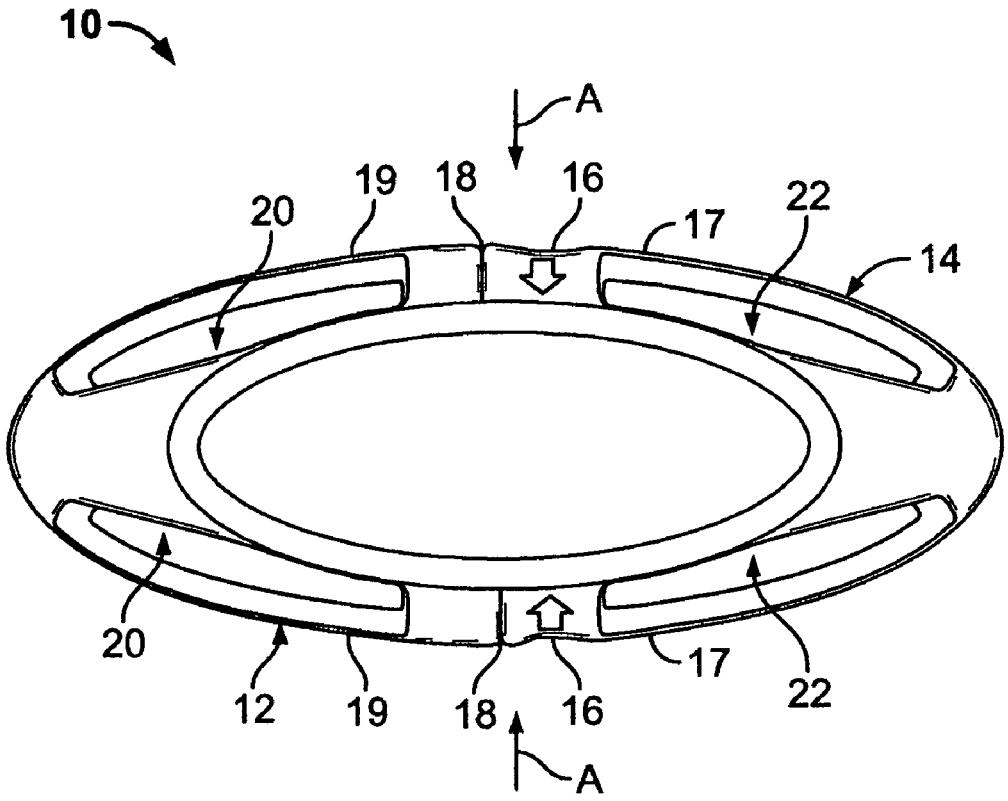
FIG. 1 illustrates a top view of a buckle assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates a top view of a buckle assembly 10 according to an embodiment of the present invention. The buckle assembly 10 is a separable assembly including a female buckle housing 12 that is mated with a male buckle housing 14. The male buckle housing 14 includes engagement members 16 located proximate a mating interface 18 between the female and male buckle housings 12 and 14. The engagement members 16 may be buttons, depressions, raised areas, switches, or the like that are configured to be squeezed, pushed, urged, or otherwise moved toward one another in the directions of arrows A in order to cause the male buckle housing 14 to be released from the female buckle housing 12. The engagement members 16 are integrally formed with lateral walls or sides 17 of the male buckle housing 14. Thus, a user may disengage the male buckle housing 14 from the female buckle housing 12 by pressing the engagement members 16 and/or the sides 17 of the male buckle housing 14.

As shown in FIG. 1, the sides 17 of the male buckle housing 14 are flush with the sides 19 of the female buckle housing 12. Optionally, the sides 17 of the male buckle housing 14 may be outside or inside those of the female buckle housing 12. Little or no portion of the female housing 12 extends over or around the sides of the engagement members 16 when the male buckle housing 14 is mated into the female buckle housing 12. When the engagement members 16 and sides 17 of the male buckle housing 14 are moved toward one other in the directions of arrows A, there is little or no fixed structure abutting or proximate the sides 17 of the male buckle housing 14 to obstruct inwardly-directed movement of the engagement members 16 and sides 17.

The female buckle housing 12 includes passages 20 that are configured to allow a strap to pass therethrough. Similarly, the male buckle housing 14 includes passages 22 that are configured to allow a strap to pass therethrough. Thus, the female buckle housing 12 and the male buckle housing 14 may slidably or otherwise moveably retain straps, such as seatbelt straps, backpack straps, or other such straps.

The buckle assembly 10 is shown having a generally arcuate shape. In particular, FIG. 1 shows the buckle assembly 10 as having an elliptical shape. Embodiments of the present invention, however, may be shaped in various other shapes, such as rectangular, triangular, other polygonal shapes, or the like.

Figure 2:
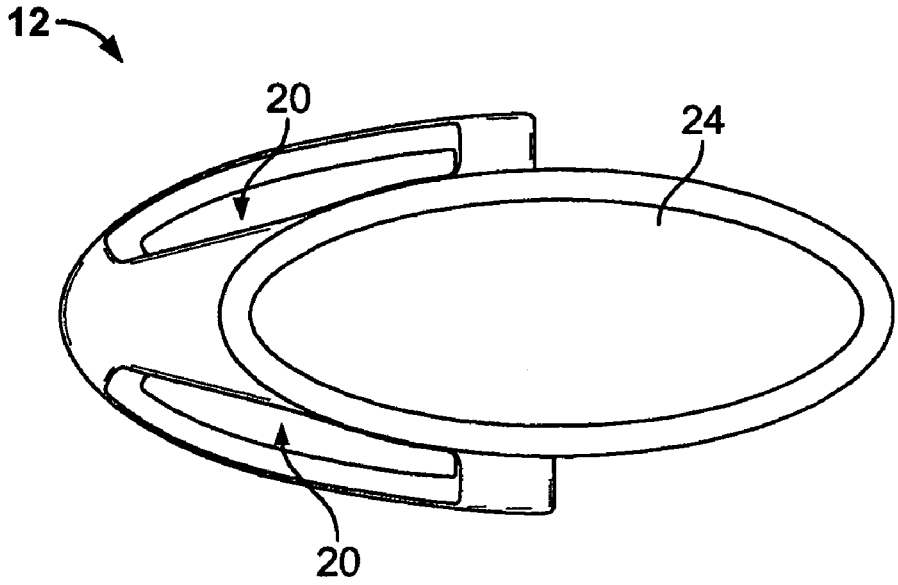
FIG. 2 illustrates a top view of a female buckle housing according to an embodiment of the present invention.

FIG. 2 illustrates a top view of the female buckle housing 12. As shown in FIG. 2, the female buckle housing 12 includes a cover 24 that is configured to cover the mating components of the female and male buckle housings 12 and 14, respectively. Alternatively, the female buckle housing 12 may not include the cover 24. Instead, the buckle assembly 10, shown in FIG. 1, may not include a cover, or the male buckle housing 14, shown in FIG. 1, may include the cover.

Figure 3:
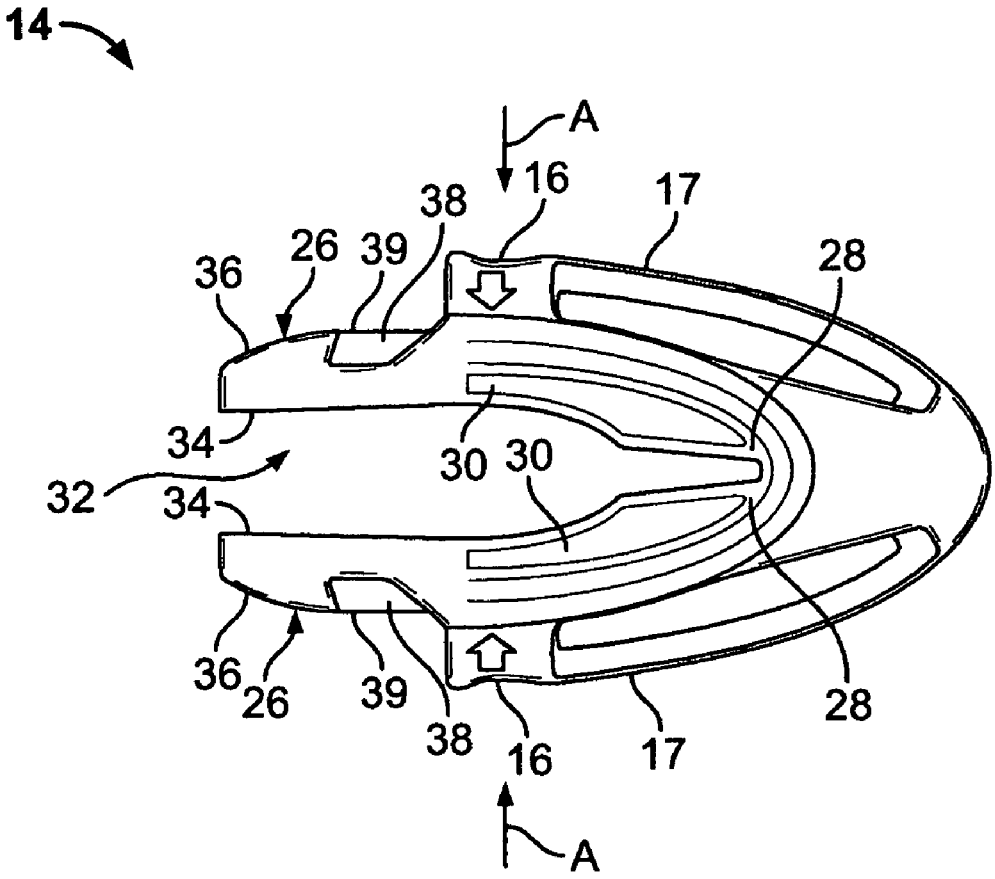
FIG. 3 illustrates a top view of a male buckle housing according to an embodiment of the present invention.
Figure 4:
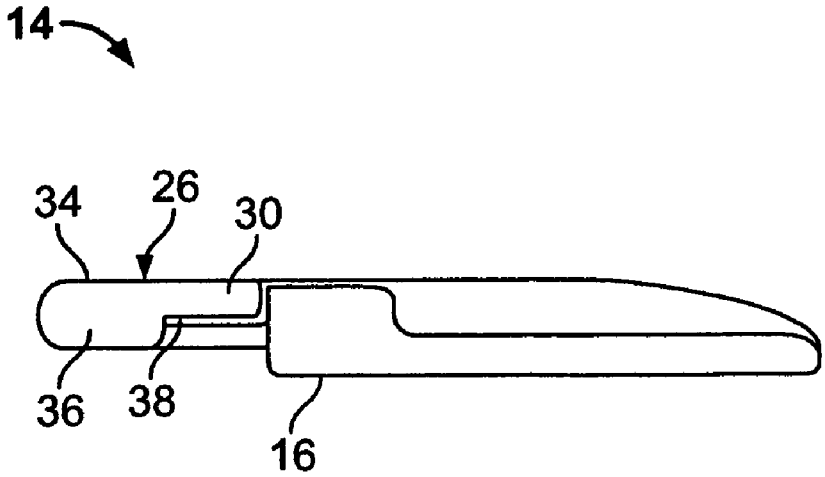
FIG. 4 illustrates a lateral view of a male buckle housing according to an embodiment of the present invention.
Figure 5:
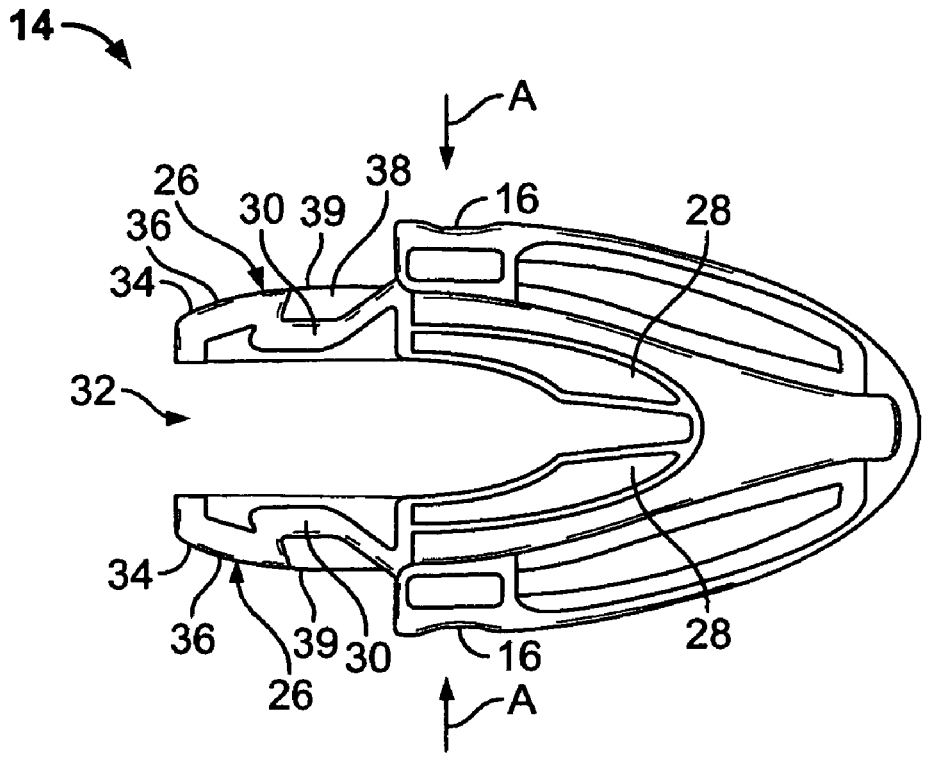
FIG. 5 illustrates a bottom view of a male buckle housing according to an embodiment of the present invention.

FIGS. 3, 4, and 5 illustrate top, lateral, and bottom views, respectively, of the male buckle housing 14. Because the male buckle housing 14 is symmetrical, each lateral portion is a mirror image of the other lateral portion. Referring to FIGS. 3-5, the male buckle housing 14 includes a pair of locking arms 26 integrally connected to the engagement members 16. Each locking arm 26 includes a base portion 28 and an extending portion 30. The base portions 28 of the locking arms 26 are integrally connected to one another, while the extending portions 30 are separated from one another by a central slot 32. As shown in FIGS. 3 and 5, the union of the locking arms 26 forms a general U or V shape. A feature of the locking arms 26 is that when they are caused to move together, the space or slot 32 between the base portions 28 and extending portions 30 changes, as compared to conventional side release buckles where a space between center guiding ribs does not change. This feature enhances the connection and separation movement of the male buckle housing 14 and female buckle housing 12 in cooperation with the guide rib 40 (see FIG. 6). The dimensionally changing slot 32 and guide rib 40 enable a generally straight line insertion and separation of the male buckle housing 14 and female buckle housing 12, as compared to a substantially angled line insertion and separation which could be possible if the slot 32 and guide rib 40 are not present. Movement of the engagement members 16 and/or the sides 17 of the male buckle housing 14 in the directions of arrows A causes a corresponding movement in the locking arms 26 towards each other within the slot 32.

Mating tips 34 are located at distal ends of the extending portions 30 of the flex arms 26. Each mating tip 34 includes an outer surface 36 located distally from the base 28, and a groove 38 located proximate the engagement member 16. In one embodiment, the surface 36 of the tips 34 is ramped or otherwise shaped to provide a camming surface. The mating tips 34 may include stacked vertical grooves separated from one another by a shelf 39. Optionally, instead of a plurality of stacked grooves 38 separated by shelves 39, the mating tips 34 may include a single groove or divot that extends through the entire height of the mating tips 34. The mating tips 34 are configured to snapably mate with reciprocal structures, such as ledges, of the female buckle housing 12, which is shown, for example, in FIGS. 1 and 2. Optionally, the mating tips 34 may be configured to latchably, or otherwise removably, secure to reciprocal structures of the female buckle housing 12. Another feature according to the present invention concerns the location of the mating tips 34 in relation to the engagement members 16. In conventional side release buckles, the mating or locking tips of the male member that engage the female member also represent the location the user pushes in to release the locking arms from the female member. Moving the location of the engagement members 16 from the mating tips 34 further enhances the operation of the mating and disengaging of the male buckle housing 14 to the female buckle housing 12 in accordance with the principles of the present invention. As illustrated, a preferred arrangement of the present invention concerns locating the mating tips 34 or locking structure forward of the engagement members 16, as compared to conventional side releases buckles that locate the locking members behind the associated engagement members.

Figure 6:
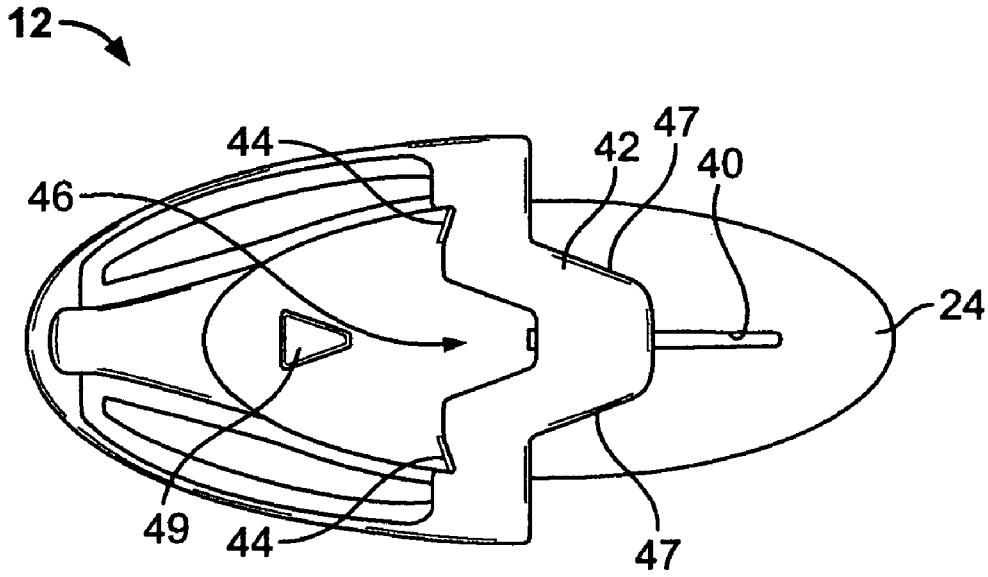
FIG. 6 illustrates a bottom view of a female buckle housing according to an embodiment of the present invention.
Figure 7:
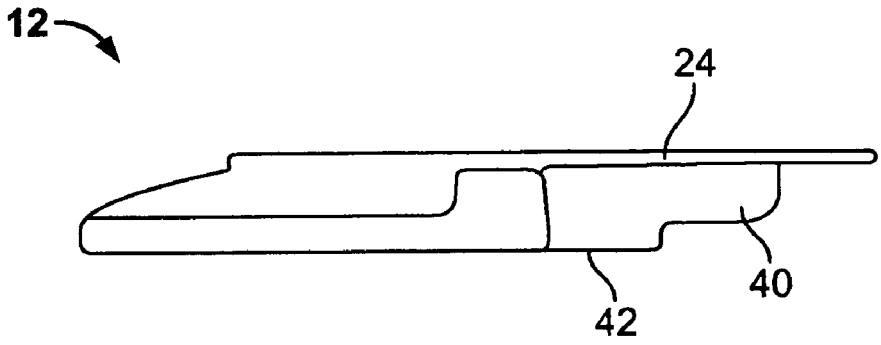
FIG. 7 illustrates a lateral view of a female buckle housing according to an embodiment of the present invention.

FIGS. 6 and 7 illustrate bottom and lateral views, respectively, of the female buckle housing 12. Because the female buckle housing 12 is symmetrical, each lateral portion is a mirror image of the other lateral portion. Referring to FIGS. 6 and 7, a guide rib 40 extends from a support base 42 to the underside of the cover 24. Alternatively, the guide rib 40 can extend from one of the support base 42 or cover 24, or from both the support base 42 and the cover 24 with a slot or other opening therebetween. The guide rib 40 is configured to ensure that the male buckle housing 14, shown, for example, in FIGS. 3-5, is properly mated with the female buckle housing 12. Additionally, the guide rib 40 also ensures that the male buckle housing 14 is properly oriented with respect to the female buckle housing 12 during an unbuckling process, thereby allowing portions of the female and male buckle housings 12 and 14 to push off one another in order to eject the male buckle housing 14 from the female buckle housing 12, or vice versa. Another feature of the guide rib 40 in cooperation with the base portions 28 of the locking arms 26 of the male buckle housing 14 is to limit lateral movement of the male buckle housing 14 with respect to the female buckle housing 12 when the members 12 and 14 are assembled together and separated from one another.

As shown in FIG. 6, the female buckle housing 12 includes a plurality of locking ledges 44 located within a mating cavity 46. The locking ledges 44 are configured to snapably, latchably, or otherwise removably secure to the mating tips 34 of the male buckle housing 14, shown, for example, in FIGS. 3-5. If, for example, the male buckle housing 14 includes a plurality of grooves 38 separated by shelves 39, the female buckle housing 12 includes a corresponding number of locking ledges 44 separated by a channel. Alternatively, the male buckle housing 14 may include locking ledges while the female buckle housing 12 includes a plurality of grooves.

The female buckle housing 12 also includes walls 47 proximate the guide rib 40. The walls 47 are preferably configured and adapted to assist in ejecting the male buckle housing 14 from the female buckle housing 12, or vice versa, during an unbuckling process. In one embodiment, the walls 47 are ramped or otherwise shaped to provide a camming surface for mating engagement with the inside portion of the engagement members 16 of the male buckle housing 14 during an unbuckling process. The walls 47 assist is ejecting the male buckling housing 14 from the female buckle housing 12. Further, the female buckle housing 12 may also include a member 49 distally located from, but aligned with, the guide rib 40. The member 49 is shaped to further assist in ejecting the male buckle housing 14 from the female buckle housing 12, or vice versa, during an unbuckling process. The tips 34 of the male buckle housing 14 engage the sides of the member 49 during an unbuckling process. The shape of the sides of the member 49 assist in causing the male buckle housing 14 to eject from the female buckle housing 12 during an unbuckling process. Another feature of the member 49 in cooperation with the tips 34 is to further limit lateral movement of the male buckle housing 14 with respect to the female buckle housing 12 when the members 12 and 14 are assembled together.

Alternatively, instead of including the guide rib 40, the female buckle housing 12 may include a guide channel. In that case, the male buckle housing 14, shown, for example, in FIGS. 3-5, may include a guide rib configured to pass through the guide channel.

Figure 8:
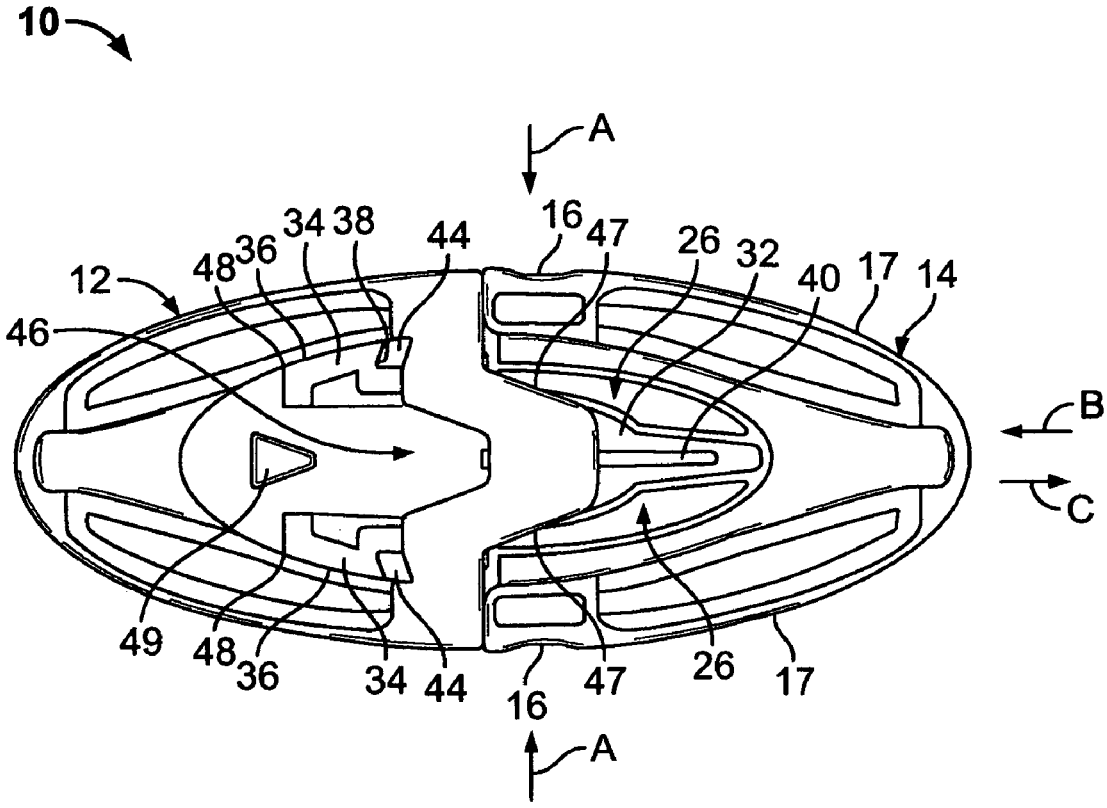
FIG. 8 illustrates a bottom view of a buckle assembly according to an embodiment of the present invention.

FIG. 8 illustrates a bottom view of the buckle assembly 10. In order to securely mate the male buckle housing 14 with the female buckle housing 12, the male buckle housing 14 is moved into the female buckle housing 12 in the direction of arrow B. As the male buckle housing 14 is moved into the female buckle housing 12, the guide rib 40 of the female buckle housing 12 moves into the slot 32 of the male buckle housing 14. The guide rib 40 guides the locking arms 26 into the female buckle housing 12 during mating. Additionally, the locking arms 26 cannot laterally move past the guide rib 40. Thus, the guide rib 40 further acts to limit lateral movement, or wiggle, of the male housing 14 relative to the female housing 12 during the mating process.

During the mating process, the mating tips 34 of the locking arms 26 engage the locking ledges 44. As the male housing 14 continues to be moved into the female buckle housing 12, the surfaces 36 of the mating tips slide over the mating surfaces of the locking ledges 44 and force the mating tips 34 inwardly toward the slot 32. Once the surfaces 36 slide past the locking ledges 44, the mating tips 34 move back to their original position and the locking ledges 44 are secured to the locking arms 26 such as by cooperation with the grooves 38, thereby securing the male buckle housing 14 to the female buckle housing 12.

As shown in FIG. 8, once the male buckle housing 14 is secured to the female buckle housing 12, the mating tips 34 are positioned near or against interior walls 48 that define the mating cavity 46. This arrangement also limits lateral movement, such as wiggling, of the male buckle housing 14 with respect to the female buckle housing 12.

In order to unbuckle the buckle assembly 10 (that is, remove the male buckle housing 14 from the female buckle housing 12), the engagement members 16 and/or the sides 17 of the male buckle housing 14 are manipulated, such as by being pushed toward one another in the directions of arrows A. The buckle assembly 10 does not include any fixed structure over or around the male buckle housing 14 proximate the engagement members 16 that blocks a user from fully engaging the engagement members 16. Thus, a bulky manipulating unit, such as a finger within a bulky mitten or glove, may manipulate the engagement member 16 without being obstructed by a fixed structure. A user may disengage the male buckle housing 14 from the female buckle housing 12 even if the manipulating unit is bigger and/or bulkier than the engagement members 16. In general, a user may disengage the male buckle housing 14 from the female buckle housing 12 by squeezing the engagement members 16 and/or the sides 17 of the male buckle housing 14 together. Any portion of the sides 17 of the male buckle housing 14, including the engagement members 16, may be manipulated to disengage the male buckle housing 14 from the female buckle housing 12, not just a small or limited portion of the buckle assembly 10.

Movement of the engagement members 16 towards one another causes a corresponding movement in the attached locking arms 26. As the locking arms 26 move toward one another, the locking ledges 44 are disengaged from the locking arms 26 or grooves 38. As the locking ledges 44 are so disengaged, the surfaces 36 of the mating tips 34 engage the inner surfaces of the locking ledges 44. The guide rib 40 may ensure that the male buckle housing 14 remains properly oriented with respect to the female buckle housing 12 so that the male buckle housing 14 may eject from the female buckle housing 12, or vice versa. The inwardly-directed flexing of the locking arms 26 toward one another produces a force in the arms 26. The stored force in the locking arms 26 forces the mating tips 34 to retreat over the locking ledges 44 and move the male buckle housing 14 in the direction of arrow C, thereby ejecting the male buckle housing 14 from the female buckle housing 12. The camming surfaces of the tips 34 and the internal surfaces of the locking ledges 44 provides a self-camming action to enable separation of the male buckle housing 14 from the female buckle housing 12. Once the mating tips 34 slide past the locking ledges 44 in the direction of arrow C, the resilient arms 26 spring back to their normal position.

In one embodiment, the walls 47 and the member 49 of the female buckle housing 12 also engage portions of the male buckle housing 14 during the unbuckling process, thereby assisting in ejecting the male buckle housing 14 from the female buckle housing 12, or vice versa. For example, as the mating tips 34 of the locking arms 26 are squeezed inwardly, the mating tips 34 engage the surfaces of the member 49, which act to push the mating tips 34, and therefore the entire male buckle housing 14 in the direction of arrow C. Similarly, intermediate portions of the locking arms 26 engage the walls 47 during this process. The walls 47 also act to push the male buckle housing 14 away from the female buckle housing 12 in the direction of arrow C. As such, unbuckling of the buckle assembly 10 is made easier.

Figure 9:
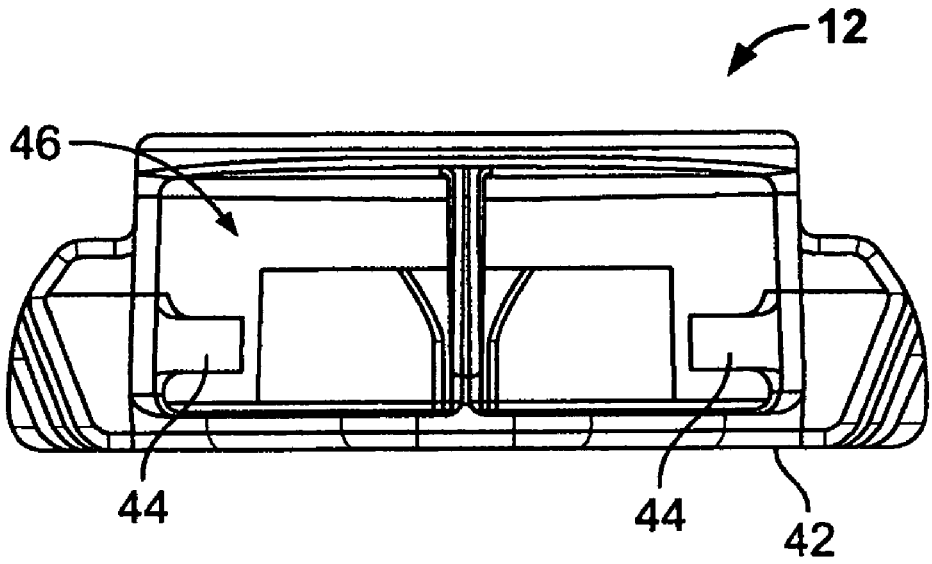
FIG. 9 illustrates a mating end view of a female buckle housing according to an embodiment of the present invention.

FIG. 9 illustrates a mating end view of the female buckle housing 12 according to an embodiment of the present invention. As shown in FIG. 9, the female buckle housing 12 may include two opposed locking ledges 44 located proximate the support base 42 within the mating cavity 46. A counterpart male buckle housing includes corresponding reciprocal grooves configured to engage the locking ledges 44.

Figure 10:
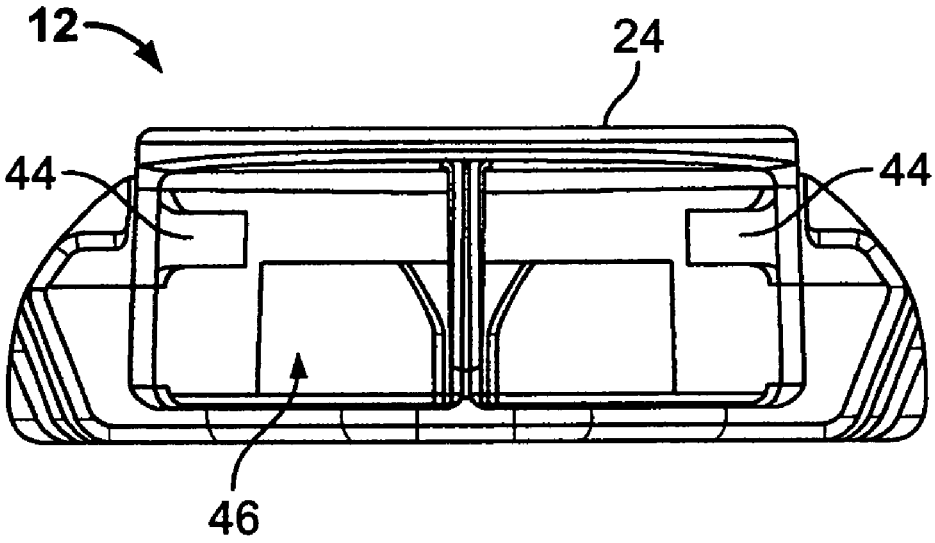
FIG. 10 illustrates a mating end view of a female buckle housing according to an embodiment of the present invention.

FIG. 10 illustrates a mating end view of the female buckle housing 12 according to an embodiment of the present invention. As shown in FIG. 10, the female buckle housing 12 may include two opposed locking ledges 44 located proximate the cover 24 within the mating cavity 46. A counterpart male buckle housing includes corresponding reciprocal grooves configured to engage the locking ledges 44.

Figure 11:
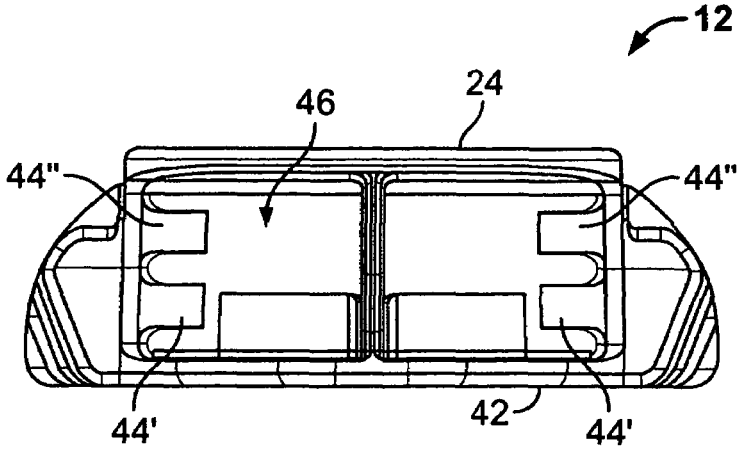
FIG. 11 illustrates a mating end view of a female buckle housing according to an embodiment of the present invention.

FIG. 11 illustrates a mating end view of the female buckle housing 12 according to an embodiment of the present invention. As shown in FIG. 11, the female buckle housing 12 may include two sets of opposed locking ledges 44' and 44". One set of locking ledges 44' is located proximate the support base 42, while the other set of locking ledges 44" is located proximate the cover 24. A counterpart male buckle housing includes corresponding reciprocal grooves configured to engage the locking ledges 44' and 44".

Figure 12:
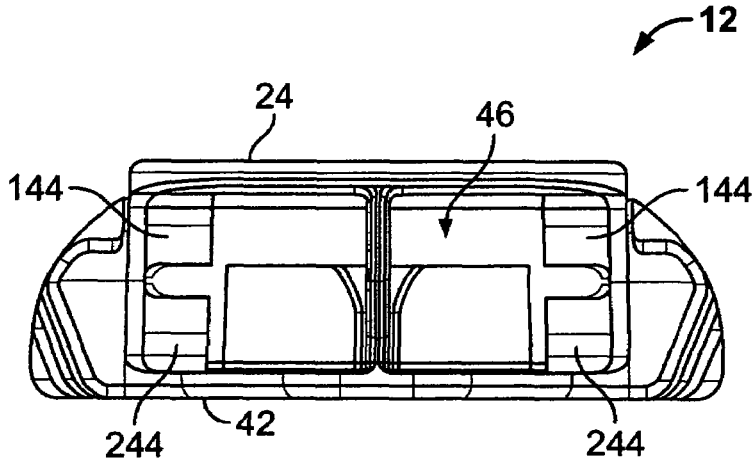
FIG. 12 illustrates a mating end view of a female buckle housing according to an embodiment of the present invention.

FIG. 12 illustrates a mating end view of the female buckle housing 12 according to an embodiment of the present invention. As shown in FIG. 12, the female buckle housing 12 may include two sets of opposed locking ledges 144 and 244. One set of locking ledges 144 is integrally formed with, and extends downwardly from, the cover 24, while the other set of locking ledges 244 is integrally formed with, and extends upwardly from, the support base 42. A counterpart male buckle housing includes counterpart reciprocal grooves configured to engage the locking ledges 144 and 244. In an alternative embodiment, the locking ledges 144 may be slightly spaced from the cover 24 for manufacturing purposes, such as preventing sink during the injection molding process.

Figure 13:
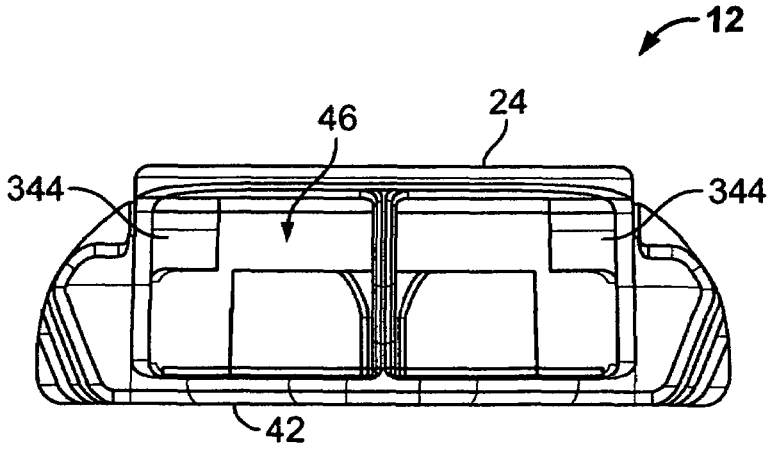
FIG. 13 illustrates a mating end view of a female buckle housing according to an embodiment of the present invention.

FIG. 13 illustrates a mating end view of the female buckle housing 12 according to an embodiment of the present invention. As shown in FIG. 10, the female buckle housing 12 may include opposed locking ledges 344 integrally formed with, and extending downwardly from, the cover 24. Alternatively, the locking ledges 344 may be integrally formed with, and extending upwardly from, the support base 42. A counterpart male buckle housing includes corresponding reciprocal grooves configured to engage the locking ledges 344.

FIGS. 9-13 are intended to illustrate examples of various structural components of the female buckle housing 12. The examples shown are not intended to be limited to these arrangements. Rather, the examples are intended to illustrate that the locking arrangements between the female buckle housing 12 and male buckle housing 14 can take on many different configurations consistent with the teachings of the present invention.

Figure 14:
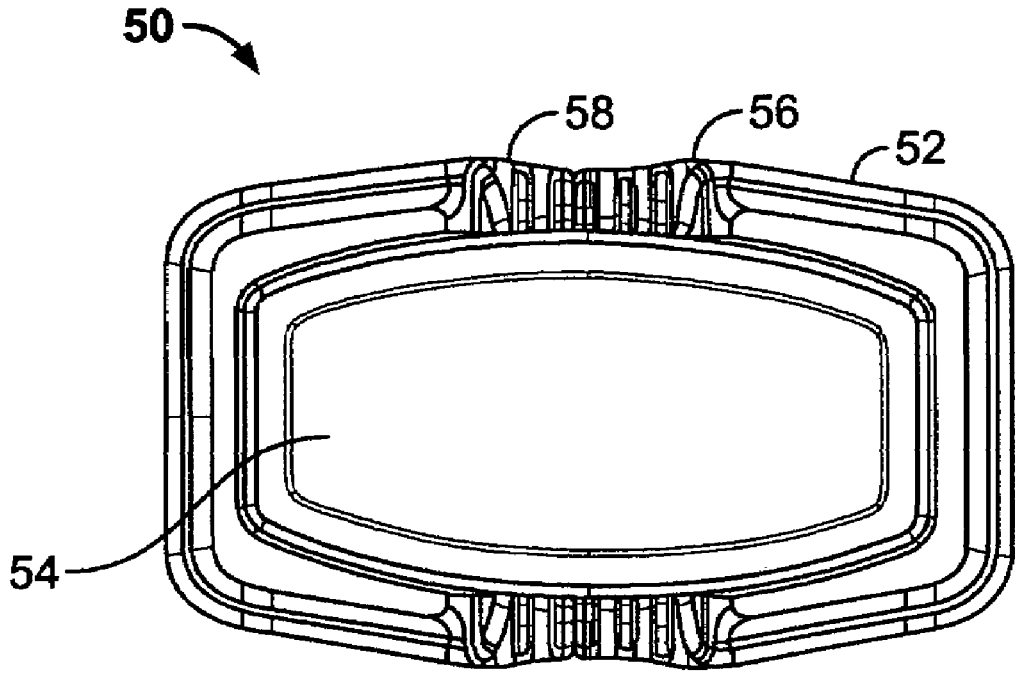
FIG. 14 illustrates a top view of a buckle assembly according to an embodiment of the present invention.
Figure 15:
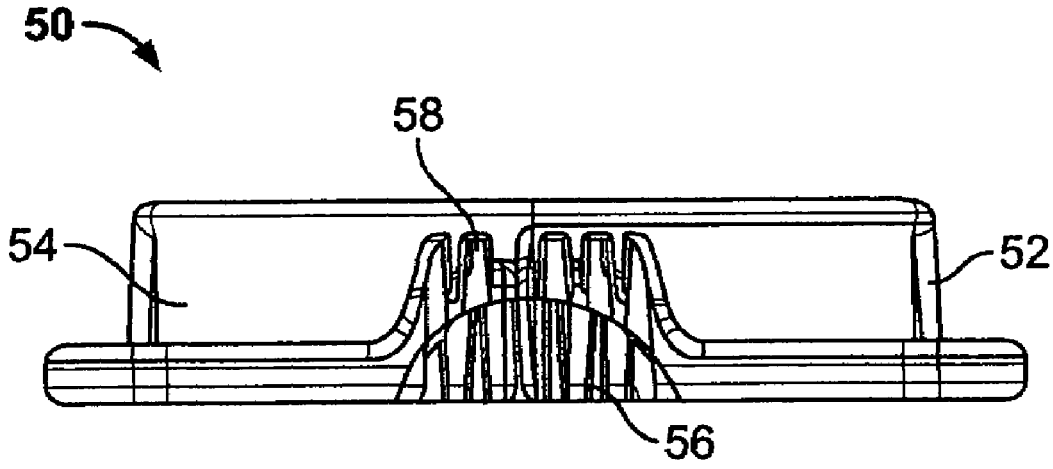
FIG. 15 illustrates a lateral view of a buckle assembly according to an embodiment of the present invention.

FIGS. 14 and 15 illustrate top and lateral views, respectively, of a buckle assembly 50 according to an embodiment of the present invention. The buckle assembly 50 is a separable assembly including male and female buckle housings 52 and 54, respectively. The male buckle housing 52 includes ribbed engagement members 56, while the female buckle housing 54 includes ribbed surfaces 58. The engagement members 56 and the engagement surfaces 58 are ribbed to assist in gripping and engaging the buckle assembly 50 during buckling and unbuckling. The engagement members 56 and the engagement surfaces 58 may be ribbed, embossed, perforated, or the like. While not shown in FIGS. 1-13, the engagement members 16 shown with respect to the buckle assembly 10 may also include similar gripping surfaces.

Figure 16:
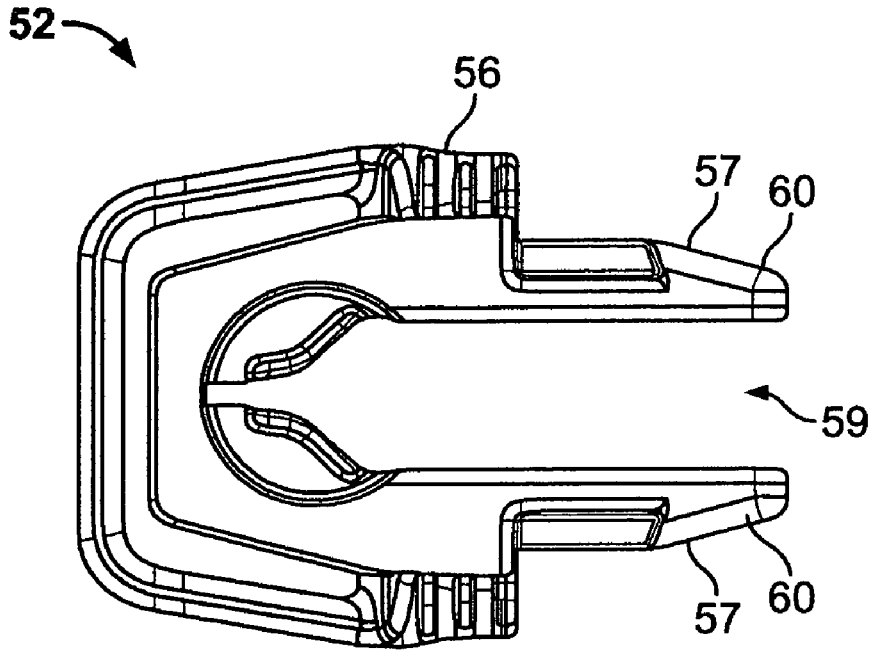
FIG. 16 illustrates a top view of a male buckle housing according to an embodiment of the present invention.
Figure 17:
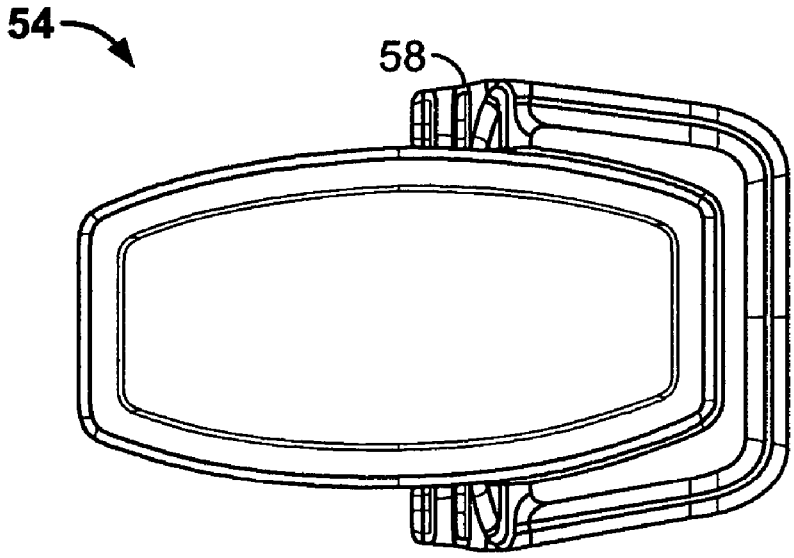
FIG. 17 illustrates a top view of a female buckle housing according to an embodiment of the present invention.

The buckle assembly 50 is similar to the buckle assembly 10, except that the buckle assembly 50 is generally rectangular. Further, as seen in FIGS. 16 and 17, some of the internal components of the male and female buckle housings 52 and 54, respectively, are of slightly different shapes than those of the female and male buckle housings 12 and 14, respectively, of the buckle assembly 10. Nevertheless, the buckle assembly 50 operates similar to the buckle assembly 10.

FIG. 16 illustrates a top view of the male buckle housing 52. Similar to the male buckle housing 14, the male buckle housing 52 includes a pair of locking arms 57 and a central slot 59 separating extending portions 60. The ribbed engagement members 56 are operatively connected to the locking arms 57. Thus, movement of the engagement members 56 produces a corresponding movement in the locking arms 57.

FIG. 17 illustrates a top view of the female buckle housing 54. The female buckle housing 54 mates with the male buckle showing 52 shown in FIG. 16 similar to the mating process described above with respect to the buckle assembly 10, shown and described with respect to FIGS. 1-13.

Alternative embodiments can include additional cord, strap or web engaging members extending off the end portions of the male and female buckle housings. Such members will provide slots or openings for receiving mating cords, straps, webs or the like.

Thus, embodiments of the present invention provide a buckle assembly that is quickly and easily buckled and unbuckled. Particularly, embodiments of the present invention provide a buckle assembly that includes a male buckle housing that is quickly and easily disengaged from a female buckle housing.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A buckle assembly comprising:

a first housing comprising first lateral walls, each lateral wall having a base end and a forward end, said first housing further comprising locking arms integrally connected with said first lateral walls such that movement of said first lateral walls causes a corresponding movement in said locking arms, said locking arms being inwardly disposed with respect to said first lateral walls, each locking arm including a base portion and an extending portion, said base portions being integrally connected to one another, while said extending portions are separated from one another by a space therebetween;

a second housing comprising second lateral walls, said second housing further comprising an interior mating cavity defined by said second lateral walls, said interior mating cavity including a guide rib, said second housing securely retaining said first housing in a mated position, said locking arms being securely retained within said interior mating cavity in the mated position, said guide rib located within said space of said first housing in the mated position, said space of said first housing being further defined as having open spaces between opposite sides of said guide rib and said associated extending portions of said locking arms in the mated position, said first housing disengaging from said second housing through manipulation of said first lateral walls at any location along said first lateral walls, wherein the manipulation of said first lateral walls causes said first housing to disengage from said second housing, such that during manipulation of said first lateral walls for disengaging said first housing from said second housing, said open spaces of said first housing change at least all along said guide rib; and wherein said locking arms comprise mating tips having lateral surfaces and grooves, and wherein said second lateral walls comprise locking ledges within said mating cavity, said locking ledges being retained by said grooves in the mated position, said mating tips being located forward of said forward ends of said first lateral walls.

2. The buckle assembly of claim 1, further comprising engagement members integrally formed with said first lateral walls.

3. The buckle assembly of claim 1, wherein said first lateral walls are flush with said second lateral walls in the mated position.

4. The buckle assembly of claim 1, wherein said mating tips are adapted to abut interior surfaces of said second lateral walls in the mated position.

5. The buckle assembly of claim 1, wherein said locking arms comprise locking ledges, and wherein said second lateral walls comprise grooves formed therein, said locking ledges being retained by said grooves in the mated position.

6. The buckle assembly of claim 1, wherein each of said first and second housings have strap passages configured to slidably retain a strap.

7. The buckle assembly of claim 1, wherein at least portions of said first lateral walls include a gripping surface.

8. The buckle assembly of claim 7, wherein said gripping surface is ribbed.

9. The buckle assembly of claim 1, wherein at least one of said first and second housings comprises camming surfaces that cause said first housing to eject from said second housing during disengagement.

10. A buckle assembly comprising:

a male buckle housing comprising male lateral walls and locking arms integrally connected with said male lateral walls such that movement of said male lateral walls causes a corresponding movement in said locking arms, said locking arms being inwardly disposed with respect to said male laterals walls, each lateral wall having a base end and a forward end, each locking arm including a base portion and an extending portion, said base portions being integrally connected to one another, while said extending portions are separated from one another by a space therebetween;

a female buckle housing comprising female lateral walls defining an interior mating cavity, said interior mating cavity including a guide rib, said locking arms being securely retained within said interior mating cavity in a mated position, said guide rib located within said space of said male buckle housing in the mated position, said space of male buckle housing being further defined as having open spaces between opposite sides of said guide rib and said associated extending portions of said locking arms in the mated position, said male buckle housing configured to disengage from said female buckle housing through manipulation of said male lateral walls at any location along said male lateral walls to move said locking arms into a disengagement position with respect to said female buckle housing, such that during manipulation of said male lateral walls for disengaging said male buckle housing from said female buckle housing, said open spaces for said male buckle housing change at least all along said guide rib; and wherein said locking arms comprise mating tips having lateral surfaces and grooves, and wherein said female lateral walls comprise locking ledges within said mating cavity, said grooves being retained by said locking ledges in the mated position, said mating tips being located forward of said forward ends of said male lateral walls.

11. The buckle assembly of claim 10, further comprising engagement members integrally formed with said male lateral walls.

12. The buckle assembly of claim 10, wherein said male lateral walls are flush with said female lateral walls in the mated position.

13. The buckle assembly of claim 10, wherein said mating tips are adapted to abut interior surfaces of said female lateral walls in the mated position.

14. The buckle assembly of claim 10, wherein said locking arms comprise locking ledges, and wherein said female lateral walls comprise grooves formed therein, said grooves being retained by said locking ledges in the mated position.

15. The buckle assembly of claim 10, wherein at least one of said male and female buckle housings comprises camming surfaces that cause said male buckle housing to eject from said female buckle housing during disengagement.

16. A buckle assembly comprising: a male buckle housing comprising male lateral walls and locking arms integrally connected with said male lateral walls such that movement of said male lateral walls causes a corresponding movement in said locking arms, each male lateral wall having a base end and a forward end, said locking arms being inwardly disposed with respect to said male laterals walls, each locking arm including a base portion and an extending portion, said base portions being integrally connected to one another, while said extending portions are separated from one another by a space therebetween, said locking arms comprising mating tips having lateral wall surfaces and grooves, said mating tips being located forward of said forward ends of said male lateral walls;

opposed engagement members integrally formed with said male lateral walls; and a female buckle housing comprising female lateral walls defining an interior mating cavity, said interior mating cavity including a guide rib, and wherein said female lateral walls comprise locking ledges within said mating cavity, said grooves being snapably retained by said locking ledges in mated position, said guide rib located within said space of said male buckle housing in the mated position, said space of male buckle housing being further defined as having open spaces between opposite sides of said guide rib and said associated extending portions of said locking arms in the mated position, said male buckle housing configured to disengage from said female buckle housing through manipulation of said male lateral walls at any location along said male lateral walls to move said locking arms into a disengagement position with respect to said female buckle housing, such that during manipulation of said male lateral walls for disengaging said male buckle housing from said female buckle housing, said open spaces of said male buckle housing change at least all along said guide rib.

17. The buckle assembly of claim 16, wherein at least one of said male and female buckle housings comprises camming surfaces that cause said male buckle housing to eject from said female buckle housing during disengagement.

18. A buckle assembly comprising:

a male buckle housing comprising a lateral wall and a locking arm integrally connected with said male lateral wall such that movement of said male lateral wall causes a corresponding movement in said locking arm, said lateral wall having a base end and a forward end, said locking arm extending from said male lateral wall and including a base portion and an extending portion, such that said extending portion is located forward of said forward end of said male lateral wall, said male buckle housing including a space therein; and a female buckle housing defining an interior cavity adapted to receive said locking arm of said male buckle housing, said interior cavity including a guide rib, said female buckle housing including a locking ledge within said cavity that is adapted to engage said locking arm of said male buckle housing to secure the male buckle housing to said female buckle housing in a mated position, said guide rib located within said space of said male buckle housing in the mated position, said space of male buckle housing being further defined as having an open space between said guide rib and said locking arm in the mated position, said male buckle housing being disengageable from said female buckle housing through manipulation of said male lateral wall at any location along said male lateral wall to move said locking arm into a disengagement position with respect to said locking ledge of said female buckle housing, such that during manipulation of said male lateral wall for disengaging said male buckle housing from said female buckle housing said open space of said male buckle housing changes at least all along said guide rib.

19. The buckle assembly of claim 18, wherein said male buckle housing further includes an engagement member located between said lateral wall and said locking arm, said engagement member adapted to provide one location for the manipulation of said lateral arm.

20. The buckle assembly of claim 18, wherein said locking arm includes a first camming surface and said locking ledge includes a second camming surface, said camming surfaces being configured such that upon insertion of said locking arm into said cavity, engagement of said camming surfaces causes said locking arm to move inward with respect to said cavity until such time as said locking arm moves past said locking ledge, whereafter said locking arm will move in a direction opposite the inward movement thereby securing said male buckle housing to said female buckle housing.

21. The buckle assembly of claim 18, wherein said lateral wall includes a first camming surface and said female buckle housing includes a second camming surface, said camming surfaces being configured such that upon moving said lateral arm inward so as to allow disengagement of said male buckle housing from said female buckle housing, engagement of said camming surfaces enhances separation of said male buckle housing from said female buckle housing.

22. The buckle assembly of claim 18, wherein said locking arm includes a first camming surface and said locking ledge includes a second camming surface, said camming surfaces being configured such that upon moving said locking arm inward so as to allow disengagement of said male buckle housing from said female buckle housing, engagement of said camming surfaces enhances ejection of said male buckle housing from said female buckle housing.

23. The buckle assembly of claim 18, wherein said male buckle housing includes a pair of lateral walls and a pair of associated locking arms, and said female buckle housing includes a pair of locking ledges adapted for cooperation with said locking arms.

24. The buckle assembly of claim 23, wherein each locking arm includes a base portion and an extending portion, said base portions being connected together and said extending portions being separated from one another to define a slot, and wherein said guide rib of said female buckle housing further is positioned to receive said slot, said locking arms being arranged such that said slot has a changing dimension during engagement and disengagement of said male buckle housing from said female buckle housing.

* * * * *